United States Patent [19]

Hill

[11] 4,387,770

[45] Jun. 14, 1983

[54] PROCESS FOR SELECTIVE INJECTION INTO A SUBTERRANEAN FORMATION

[75] Inventor: Alfred D. Hill, Littleton, Colo.

[73] Assignee: Marathon Oil Company, Findlay, Ohio

[21] Appl. No.: 206,124

[22] Filed: Nov. 12, 1980

[51] Int. Cl.[3] ..... E21B 43/16

[52] U.S. Cl. ..... 166/305 R; 166/269

[58] Field of Search ..... 166/291, 268, 269, 305 R, 166/307

[56] References Cited

U.S. PATENT DOCUMENTS

| | | | |
|---|---|---|---|
| Re. 30,484 | 1/1981 | Broaddus et al. | 166/307 |
| 1,661,270 | 3/1928 | Ryder et al. | 166/269 X |
| 1,916,122 | 6/1933 | Grebe | 166/282 X |
| 1,969,230 | 8/1934 | McMillen | 166/307 |
| 2,223,397 | 12/1940 | White et al. | 166/291 X |
| 2,259,429 | 10/1941 | Simmons | 166/307 |
| 2,524,933 | 10/1950 | Silverman | 166/307 X |
| 2,869,642 | 1/1959 | McKay et al. | 166/307 X |
| 3,372,752 | 3/1968 | Prater | 166/280 |
| 3,666,014 | 5/1972 | Beard | 166/306 X |
| 4,275,788 | 6/1981 | Sweatman | 166/285 X |

*Primary Examiner*—Stephen J. Novosad
*Assistant Examiner*—George A. Suchfield
*Attorney, Agent, or Firm*—Jack L. Hummel

[57] ABSTRACT

A treating fluid is selectively injected into a portion of subterranean formation by creating a fluid interface within a well bore penetrating and communicating with the formation. The fluid interface is created by injecting preflush fluids of differing densities into the well bore, and is maintained at a vertical location within the well bore adjacent the portion of the subterranean formation to be treated while treating fluid is injected into the well bore.

7 Claims, 2 Drawing Figures

PROCESS FOR SELECTIVE INJECTION INTO A SUBTERRANEAN FORMATION

DESCRIPTION

Technical Field

The invention relates to a process for selectively injecting a treating fluid into a portion of a subterranean formation to be treated, and more particularly, to a process for selectively injecting a treating fluid into a portion of a subterranean formation to be treated by utilizing a preflush of a more dense, immiscible fluid and a preflush of a less dense, immiscible fluid.

Background Art

A well bore for producing hydrocarbons from a subterranean formation is completed through various intervals or zones of varying permeability or, an individual zone or interval of a subterranean formation through which a well is completed may have a varying vertical permeability profile. In many well treatment processes, such as, vertical conformance and flow profile treatments, sand consolidation treatments, matrix acidization treatments and clay stabilization treatments, treatment of, and therefore injection of a treating fluid into, only one distinct zone of a subterranean formation, or only one district portion of a zone of subterranean formation, is highly desirable.

In treating a specific zone of a subterranean formation or a specific portion of a zone, conventional mechanical packer assemblies have heretofore been employed to isolate the zone or portion thereof to be treated. However, the use of such packer assemblies requires that production tubing and equipment be removed from the well and the well bore shut in while the packer assembly is set, and therefore, is relatively expensive. In addition, where the subterranean zone or portion thereof to be treated is located at a substantial depth below earth's surface, placement of a packer assembly at such depth is often impractical. Thus a need exists for alternative processes for selectively injecting a treating fluid into a subterranean zone or a portion thereof to be treated.

U.S. Pat. No. 3,954,142 to Broaddus, et al discloses a process for carrying out a variety of fracture related treatments in a desired zone of a well formation, such as, the placement of propping agents in a particular zone or fracture acidizing treatments of a particular zone. The process involves the sequential injection of at least one preflush fluid having a density differing from that of a subsequently injected treating fluid into a fractured subterranean formation wherein the treating fluid segregates from the preflush fluid(s) within the fracture or fractures, and thus is caused to flow into a desired zone within the fracture or fractures by the preflush fluid(s). The fluids are selected to have a specific gravity difference at the conditions within the formation. When the treating fluid utilized is an acid, the density change of the treating fluid caused by reaction with formation material must be taken into consideration when selecting the required densities of preflush fluids. In all instances, a sufficient pressure is maintained on the treating fluid to maintain formation fractures in an open position so that the fracture is extended. The fractures present in the subterranean formation may be either actual fractures or artificially induced by, for example, a pressurized preflush fluid. When confinement of a treating fluid to an intermediate zone of a fractured subterranean formation is desirable, a relatively heavy preflush fluid and a separate, relatively light preflush are first injected into a fractured formation, followed by the treating fluid. However, the process of U.S. Pat. No. 3,954,142 is directed solely to placement of a treating fluid within a fractured subterranean formation and to fracture related treatments. As this process relies on gravity segregation within fractures originally present or induced in a subterranean formation, as fluid flow within subterranean formations is unpredictable and largely uncontrollable, and as this process requires placement of the fluid in the formation at a pressure sufficient to maintain the fractures in an open position and to extend the same, this process is dependent upon several parameters which reduce the overall efficiency thereof. Thus, a need exists for a process for selectively injecting a treating fluid into a subterranean zone or portion thereof which does not involve fracturing pressures nor gravity segregation within a subterranean formation.

Disclosure of Invention

The present invention provides a process for selectively injecting a treating fluid into a portion of a subterranean hydrocarbon-bearing formation. At least one fluid interface is created within a well bore penetrating and communicating with the formation at a vertical location adjacent the portion of the subterranean formation to be treated. The fluid interface is created between two fluids having densities significantly less than and greater than the density of the treating fluid, respectively. The two fluids may be injected into the well bore, or if immiscible formation fluids are present in the well bore and have a density significantly differing from the density of the treating fluid, only one fluid need be injected. All fluid interfaces thus created are maintained at a vertical location adjacent the portion of the subterranean formation to be treated while treating fluid is injected into the well bore. The injected treating fluid segregates by gravity to the fluid interface, or if two fluid interfaces are created to a location between two fluid interfaces, and is forced into the portion of the formation at a pressure less than the formation fracturing pressure.

BEST MODE FOR CARRYING OUT THE INVENTION

The present invention relates to a process for selectively injecting a treating fluid into a zone of a subterranean formation or any portion thereof to be treated. Immiscible preflush fluids having densities differing from the density of a treating fluid are injected into a well bore which penetrates a subterranean formation and permitted to segregate by gravity within the well bore, thus defining an interface within the well bore. The vertical position of the interface within the well bore can be selectively controlled, so as to control the point of introduction into the subterranean formation of a subsequently injected treating fluid having a density intermediate that of the preflush fluids. Where formation fluids present within a well bore have a density intermediate that of the injected preflush fluids, and substantially similar to that of the treating fluid to be injected, or where the formation fluids are miscible with the treating fluid, the position of each interface formed within the well bore between each injected fluid and the formation fluids is controlled to control an area of introduction of the treating fluid into the formation. Where the density of the formation fluids substantially differs from that of the treating fluid to be injected and the formation fluids are immiscible with the treating fluid, the formation fluids can be utilized in lieu of one of the injected preflush fluids. As utilized throughout this description, the term "gravity segregation" refers to varying migration of fluids of differing densities injected into or present within a well bore which penetrates and communicates with a subterranean formation, the fluids being separated by gravity into distinct layers defining a fluid interface therebetween.

Figure 1:
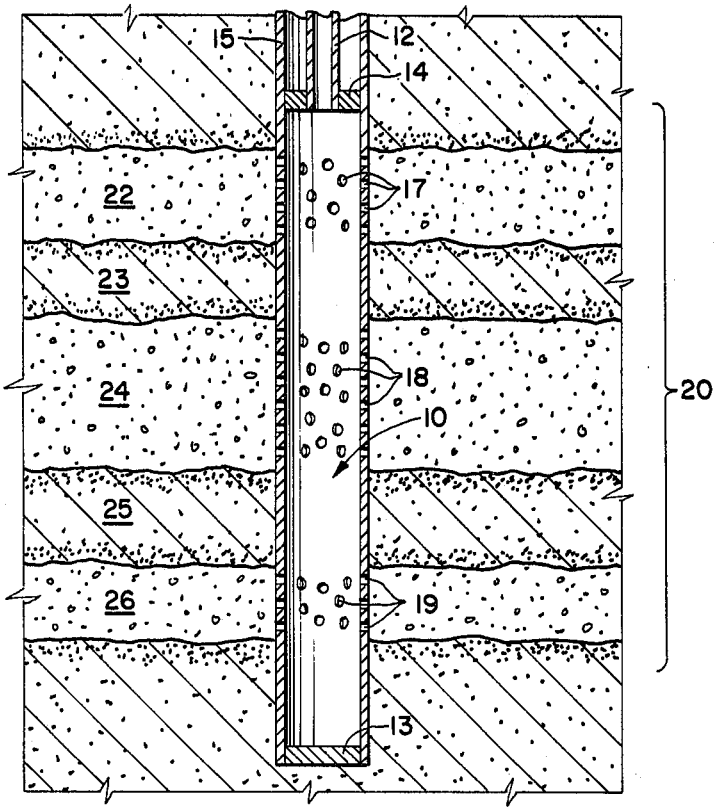
FIG. 1 is a schematic representation of a subterranean formation and a well bore completed therein.

The vertical location of an interface between fluids of differing densities within a well bore can be selectively controlled by controlling the relative amounts of fluids injected into the well bore. Thus, the precise location at which a subsequently injected treating fluid possessing an intermediate density enters the subterranean formation penetrated by the well bore can be correspondingly controlled. Referring now to FIG. 1, a well bore 10 is illustrated as penetrating and communicating with a subterranean formation illustrated generally as 20. Well bore 20 has a conventional production tubing 12 extending from the surface downwardly to a location above subterranean formation 20. Well bore 10 is further provided with conventional casing 15 which is cemented to well bore 10 as will be evident to the skilled artisan. Conventional packer assembly 14 is positioned at the lower end of production tubing 12, and as set, seals the annular space between the production tubing 12 and well bore 10 so as to prevent flow of formation fluids between the annular space therebetween. The lower portion of well bore 10 can be completed by any conventional means, for example, by a cement plug or a conventional packer assembly 13. Subterranean formation 20 consists of alternating, relatively porous zones 22, 24 and 26 and impermeable zones 23 and 25. Casing 15 is provided with spaced apart sets of perforations 17, 18 and 19 to place porous zones 22, 24 and 26 respectively, into fluid communication with well bore 10. As porous zones 22, 24 and 26 have differing permeabilities, treating fluids injected via well bore 10 into subterranean formation 20 will preferentially enter the porous zone of the subterranean formation 20 having the greatest permeability. However, it is often desirable to inject substantially all of the treating fluid into one of the porous zones of the subterranean formation.

Figure 2:
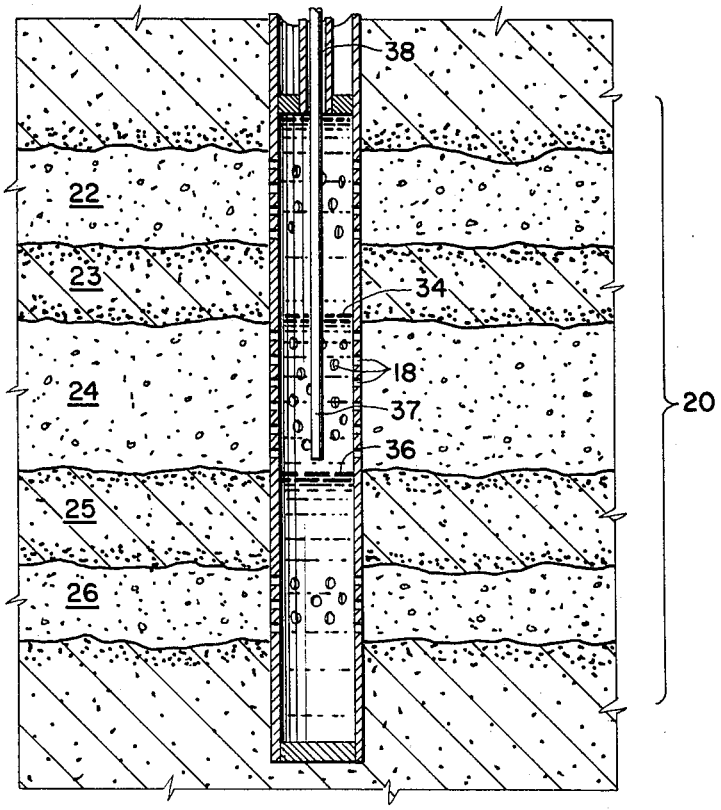
FIG. 2 is a schematic representation of a subterranean formation and a well bore completed therein after application of a portion of the process of the present invention.

Thus, in accordance with the process of the present invention, relatively small quantity of immiscible preflush fluid having a density greater than that of the treating fluid and a relatively small quantity of a immiscible preflush fluid have a density less than that of the treating fluid are injected into the well bore and allowed to separate by gravity segregation to define a fluid interface. The vertical location of this fluid interface within the well bore 10 can be maintained adjacent to the porous zone to be treated by controlling the relative volumes of preflush fluids injected. Where formation fluids having a density intermediate the density of the injected preflush fluids are present in the well bore, each preflush fluid will form a fluid interface with the formation fluids in the well bore. As illustrated in FIG. 2, the preflush fluid having a density greater than that of the subsequently injected treating fluid and the formation fluids will form fluid interface 36 with the formation fluids, while the preflush fluid having a density less than that of the treating fluid and the formation fluids will form fluid interface 34 with the formation fluids. Where substantially all of the treating fluid is to be injected into porous zone 24, interface 34 is vertically positioned adjacent the uppermost portion of perforations 18 while interface 36 is positioned adjacent the lowermost portion of perforations 18. Subsequently, a treating fluid having a density intermediate the densities of the preflush fluids is injected via either work string 37 or annulus 38 while the preflush fluids are simultaneously injected via the flow paths previously described to maintain the vertical location of interfaces 34 and 36 within the well bore 10 as just described. The injected treating fluid segregates between interfaces 34 and 36 are is injected into well bore 10 at a pressure sufficient to enter porous zone 24 without fracturing the same. It will be appreciated by the skilled artisan that when the formation fluids have a density significantly different from that of the treating fluid and are immiscible with the treating fluid, the formation fluids can be utilized in lieu of one of the preflush fluids in practicing the process of the present invention.

Alternatively, the treating fluid can be selectively injected into a desired zone by first sequentially injecting alternate slugs of the more dense immiscible preflush fluid and the less dense immiscible preflush fluid. Injecting alternate slugs of preflush fluids and the treating fluid can be repeated until the desired volume of treating fluid has been placed within zone 24. The less dense preflush fluid can be injected prior to the more dense preflush fluid without deleteriously affecting the process of the present invention. Where formation fluids are utilized in lieu of one of the injected preflush fluids, the other preflush fluid and the treating fluid can be injected either simultaneously or sequentially.

The process of the present invention is applicable to the selective injection of any treating fluid into a subterranean formation at pressures less than the pressure required to fracture the formation. The fracturing pressure of a given subterranean formation can be readily determined by the skilled artisan. If the treating fluid is an aqueous fluid, the preflush fluid having a greater density can be any dense, non-aqueous liquids, such as, ortho-nitrotoluene, carbon disulfide, dimethylphthalate, nitrobenzene, or isoquinoline, and the preflush fluid having a lower density can be any hydrocarbon fluid possessing a lower density than water, such as, kerosene, diesel, or crude oil. If the treating fluid is a non-aqueous liquid, the former preflush fluid can be any aqueous fluid having a density greater than the non-aqueous liquid, such as, water containing salts, for example, sodium chloride and potassium chloride, and the latter preflush fluid can be any fluid having a density less than the non-aqueous fluid, such as, a gas.

The following example is illustrative of the application of the process of the present invention and is not to be construed as limiting the scope thereof.

EXAMPLE 1

A subterranean formation having three distinct, porous zones separated and bounded by impervious zones is penetrated by a well bore which is perforated so as to provide fluid communication with each zone. During steady state injection, 20% of all fluids injected enter uppermost zone no. 1, 70% enter intermediate zone no. 2, and 10% enter lowermost zone no. 3. A production tubing is positioned within the well bore and a conventional packer assembly is set in the annulus between the well bore and the production tubing to prevent fluid flow therethrough. A small diameter work string is positioned within the production tubing and extends to the lower end thereof. An aqueous treating solution having an organic polymer dissolved therein is simultaneously injected with an immiscible isoquinoline fluid via the work string and kerosene is simultaneously injected via the annulus between the work string and the production tubing. Kerosene is injected at a volumetric flow rate (bbl/min) equal to 20% of the total volumetric flow rate of fluids injected into the well bore, the aqueous polymer solution is injected at a volumetric flow rate equal to 70% of the total volumetric flow rate, and isoquinoline is injected at 10% of the total volumetric flow rate. Such injection should result in substantially all of the aqueous polymer treating solution being displaced within zone no. 2.

Thus, in accordance with the present invention, a treating fluid can be selectively placed within a porous zone of a subterranean formation by creating and maintaining fluid interfaces at vertical locations within a well bore which are adjacent the porous zone. By employing the process of the present invention, the need for mechanical packer assemblies to isolate a given porous zone or for fractures within the subterranean formation is obviated. And although the process of the present invention has been described with respect to a subterranean formation having a plurality of porous zones which communicate with a well bore, the present invention is equally applicable to treat only a selected portion of one porous zone in fluid communication with a well bore.

While the foregoing preferred embodiment of the invention has been described and shown, it is understood that the alternatives and modifications, such as those suggested, and others may be made thereto, and fall within the scope of the invention.

I claim:

1. A process for selectively injecting a fluid into a subterranean formation having at least one porous, hydrocarbon-containing zone vertically bounded by substantially impervious zones, said subterranean formation penetrated by a well bore which is in fluid communication with each of said at least one porous zone, wherein formation fluids which are immiscible with said injected fluid and which have a density substantially greater than the density of said injected fluid are initially present within said well bore, said process comprising:

creating at least one fluid interface between fluids having differing densities at a vertical location within said well bore adjacent one of the porous zones by injecting into said well bore a preflush fluid having a density substantially less than the density of said injected fluid, said preflush fluid being injected at a volume sufficient to establish a fluid interface with said formation fluids at a vertical location within said well bore adjacent to said one of the porous zones; and injecting a fluid having a density intermediate the densities of said preflush fluid and said formation fluids into said well bore and into said one porous zone at a pressure less than the formation fracturing pressure, said injected fluid being vertically located within said well bore and injected into said one porous zone at said at least one fluid interface.

2. The process of claim 1 wherein said preflush fluid and said injected fluid are sequentially injected into said well bore.

3. The process of claim 1 wherein said preflush fluid and said injected fluid are simultaneously injected into said well bore.

4. A process for selectively injecting a fluid into a subterranean formation having at least two porous, hydrocarbon-containing zones vertically separated and bounded by substantially impervious zones, said subterranean formation penetrated by a well bore which is in fluid communication with each of said at least two porous zones, wherein formation fluids which are immiscible with said injected fluid and which have a density substantially less than the density of said injected fluid are initially present within said well bore, said process comprising:

creating at least one fluid interface between fluids having differing densities at a vertical location within said well bore adjacent one of said at least two porous zones, by injecting into said well bore a preflush fluid having a density substantially greater than the density of said injected fluid, said preflush fluid being injected at a volume sufficient to establish a fluid interface with said formation fluids at a vertical location within said well bore adjacent to said one of the porous zones; and injecting a fluid having a density intermediate the densities of said preflush fluid and said formation fluids into said well bore and into said one porous zone at a pressure less than the formation fracturing pressure, said injected fluid being vertically located within said well bore and injected into said one porous zone at said at least one fluid interface.

5. The process of claim 4 wherein said preflush fluid and said injected fluid are sequentially injected into said well bore.

6. The process of claim 4 wherein said preflush fluid and said injected fluid are simultaneously injected into said well bore.

7. A process for selectively injecting a fluid into a subterranean formation having at least two porous, hydrocarbon-containing zones vertically separated and bounded by substantially impervious zones, said subterranean formation penetrated by a well bore which is in fluid communication with each of said at least two porous zones, wherein formation fluids which are miscible with said injected fluid are initially present within said well bore, said process comprising:

creating at least one fluid interface between fluids having differing densities at a vertical location within said well bore adjacent one of said at least two porous zones by sequentially injecting into said well bore a first preflush fluid having a density substantially greater than the density of said injected fluid and the density of said formation fluids, said first preflush fluid being injected at a volume sufficient to establish a fluid interface with said formation fluids at a vertical location within said well bore adjacent to said one of the porous zones, followed by a second preflush fluid having a density substantially lower than the density of said injected fluid and the density of said formation fluids, said second preflush being injected at a volume sufficient to establish a fluid interface with said formation fluids at a vertical location within said well bore adjacent to said one of the porous zones; and injecting a fluid having a density intermediate the densities of said first preflush fluid and said second preflush fluid into said well bore and into said one of the porous zones at a pressure less pg,18 than the formation fracturing pressure, subsequent to the step of creating said at least one fluid interface said injected fluid being vertically located within said well bore and injected into said one of the porous zones at said at least one fluid interface.

* * * * *

UNITED STATES PATENT AND TRADEMARK OFFICE

CERTIFICATE OF CORRECTION

PATENT NO. : 4,387,770

DATED : June 14, 1983

INVENTOR(S) : Alfred D. Hill

It is certified that error appears in the above-identified patent and that said Letters Patent are hereby corrected as shown below:

Col. 3, line 30: Delete "Well bore 20" and insert --Well bore 10--.
Col. 4, line 20: Delete "are" and insert --and--.
Col. 7, line 6: Delete "pg,18".

Signed and Sealed this

*Thirteenth* Day of *September 1983*

[SEAL]

*Attest:*

GERALD J. MOSSINGHOFF

*Attesting Officer* *Commissioner of Patents and Trademarks*